US006059165A

United States Patent [19]

Deng

[11] Patent Number: 6,059,165

[45] Date of Patent: May 9, 2000

[54] STAPLER

[76] Inventor: Jinn-Yi Deng, No. 11, Alley 10, Chung-Tsun Lane, Yung-Chun Village, Hua-Tan Hsiang, Changhua Hsien, Taiwan

[21] Appl. No.: 09/351,658

[22] Filed: Jul. 13, 1999

[51] Int. Cl.[7] ..... B25C 5/02

[52] U.S. Cl. ..... 227/109; 227/134

[58] Field of Search ..... 227/134, 120, 227/109, 119

[56] References Cited

U.S. PATENT DOCUMENTS

| | | | |
|---|---|---|---|
| 2,716,749 | 9/1955 | Timmerbeil | 227/109 |
| 2,798,218 | 7/1957 | Allen | 227/109 |
| 3,958,738 | 5/1976 | Tremblay | 227/109 |
| 4,552,296 | 11/1985 | Sheng | 227/109 |
| 4,556,161 | 12/1985 | Oide | 227/120 |
| 5,337,945 | 8/1994 | Fehrle et al. | 227/109 |
| 5,931,364 | 8/1999 | Dennis | 227/120 |
| 5,931,365 | 8/1999 | Huang | 227/109 |

*Primary Examiner*—Scott A. Smith
*Attorney, Agent, or Firm*—Gardere & Wynne, LLP; Sanford E. Warren, Jr.

[57] ABSTRACT

A stapler includes a support base, a guide base having one end pivotally attached to the rear end of the support base, a staple magazine mounted in the guide base and including an outer magazine secured in the guide base and an inner magazine secured in the outer magazine, a slide base slidably mounted on the guide base and including an outer pusher slidably mounted between the guide base and the outer magazine, and an inner pusher secured in the outer pusher and slidably mounted between the outer magazine and the inner magazine, and a press cover having one end pivotally attached to the first end of the support base.

11 Claims, 6 Drawing Sheets

STAPLER

CROSS-REFERENCES TO RELATED APPLICATIONS

Not Applicable.

BACKGROUND OF THE INVENTION

1. Field of the Invention

The present invention relates to a stapler.

2. Description of the Related Art

The closest prior art of which the applicant is aware is disclosed in U.S. Pat. No. 2,723,392 to Cole, entitled "Means For Varying The Opening Between The Base And The Stapling Arm Of Stapling Machines", U.S. Pat. No. 2,239,935 to Scherman, entitled "Stapling Mechanism", and U.S. Pat. No. 3,630,428 to Olney, entitled "Stapling Machine". However, the stapler of the prior art references is used for staples of one size only, and cannot be used for staples of different sizes, thereby limiting the versatility of the stapler. The present invention has arisen to mitigate and/or obviate the disadvantage of the conventional stapler.

BRIEF SUMMARY OF THE INVENTION

In accordance with one aspect of the present invention, there is provided a stapler comprising a support base, a guide base, the rear end pivotally attached to the rear end of the support base, a staple magazine mounted in the guide base and including an outer magazine secured in the guide base and an inner magazine secured in the outer magazine, a slide base slidably mounted on the guide base and including an outer pusher slidably mounted between the guide base and the outer magazine, and an inner pusher secured in the outer pusher and slidably mounted between the outer magazine and the inner magazine, and a press cover, the rear end pivotally attached to the rear end of the support base.

Further benefits and advantages of the present invention will become apparent after a careful reading of the detailed description with appropriate reference to the accompanying drawings.

DETAILED DESCRIPTION OF THE INVENTION

Figure 1:
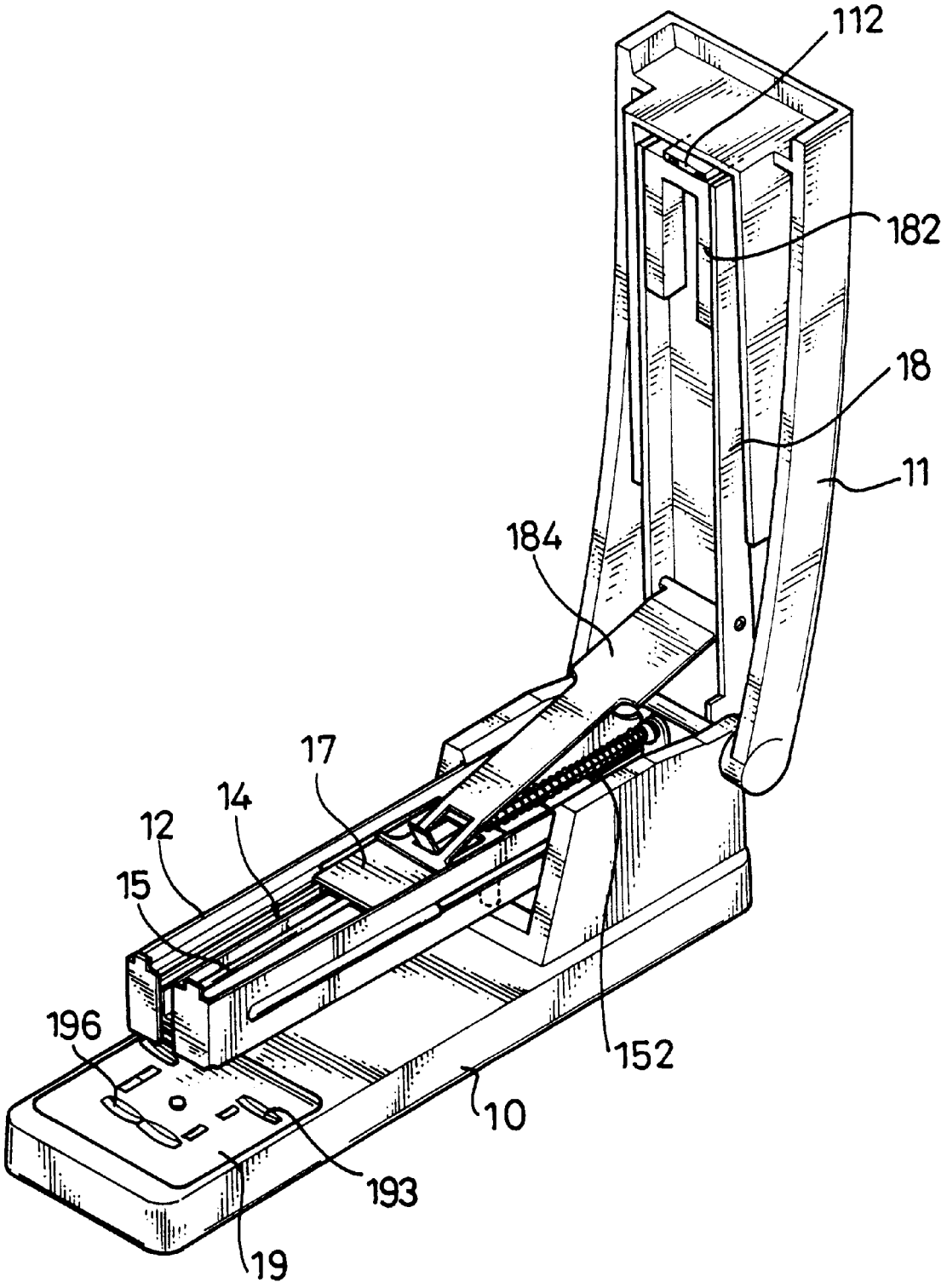
FIG. 1 is a perspective view of a stapler in accordance with the present invention.
Figure 2:
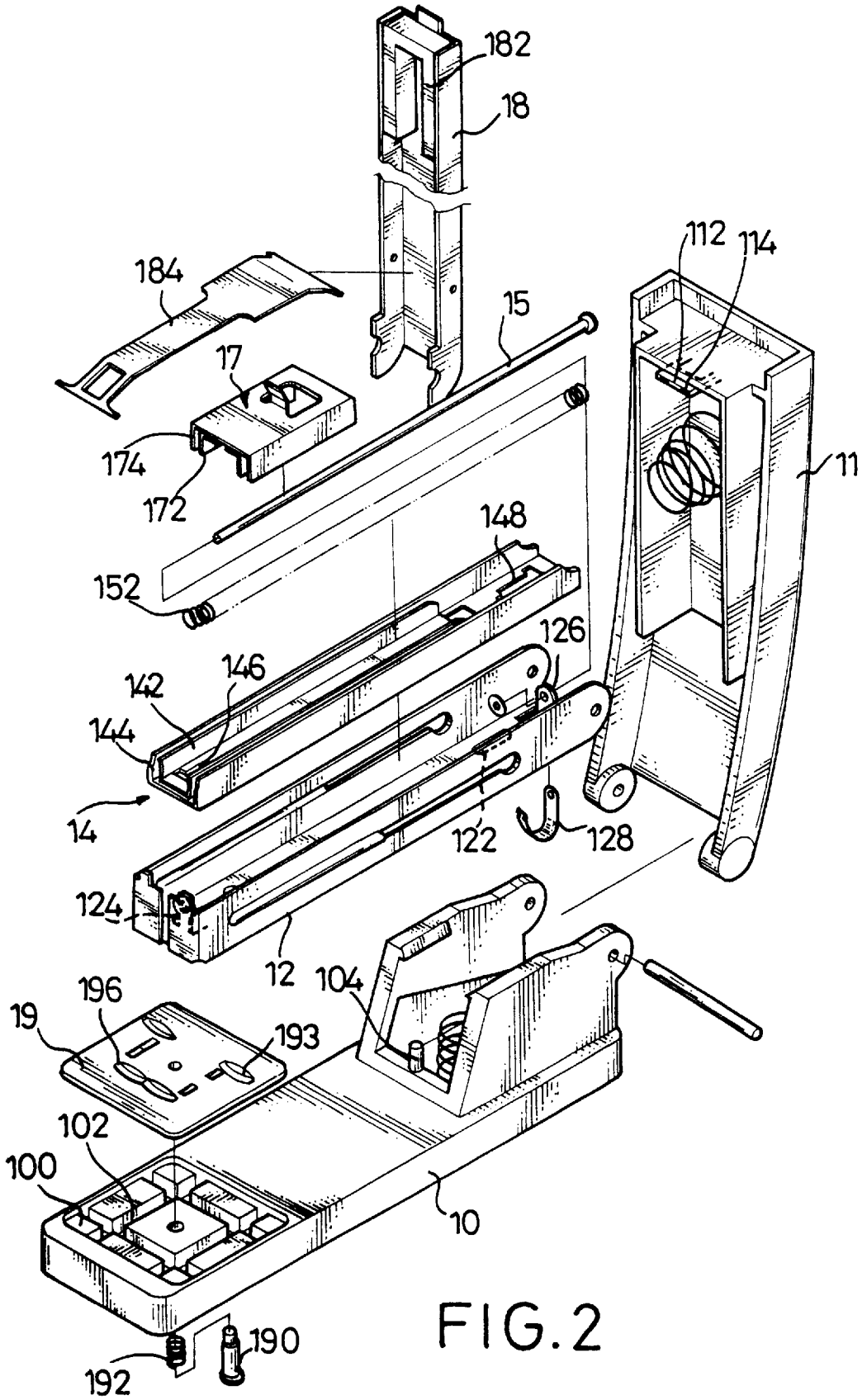
FIG. 2 is an exploded perspective view of the stapler as shown in FIG. 1.
Figure 3:
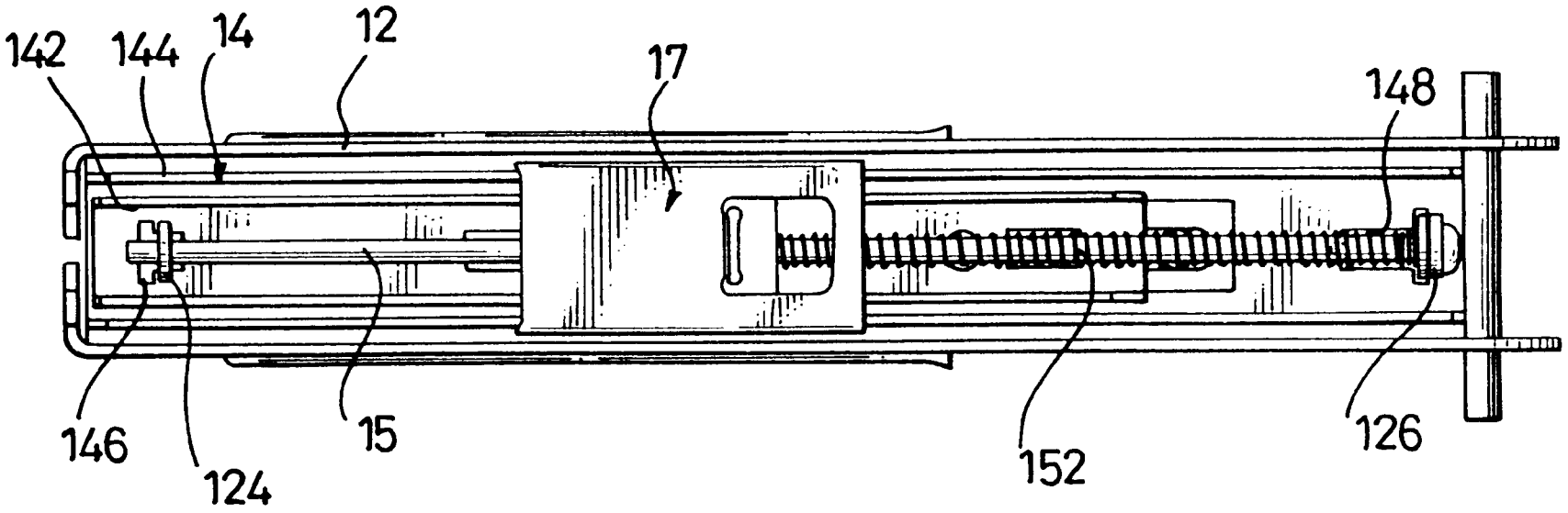
FIG. 3 is a top plan view of the stapler as shown in FIG. 1.

Referring to the drawings and initially to FIGS. 1–3, a stapler in accordance with the present invention comprises a support base (10), a guide base (12) having one end pivotally attached to the rear end of the support base (10) and the other end containing a staple ejection slot (not shown), a staple magazine (14) mounted in the guide base (12) and including an outer magazine (144) secured in the guide base (12) and an inner magazine (142) secured in the outer magazine (144), a slide base (17) slidably mounted on the guide base (12) and including an outer pusher (174) slidably mounted between the guide base (12) and the outer magazine (144), and an inner pusher (172) secured in the outer pusher (174) and slidably mounted between the outer magazine (144) and the inner magazine (142), and a press cover (11) having one end pivotally attached to the rear end of the support base (10) and the other end including a staple ejector (112) protruding down.

The stapler further comprises an end cap (18) mounted in the press cover (11), and having one end pivotally attached to the first end of the press cover (11) and the staple ejector (112) secured to of the other end of the press cover (11), a press block (182) secured in the front end of the end cap (18), and a linking member (184) having one end pivotally attached to the rear end of the end cap (18) and the other end secured to the slide base (17).

The support base (10) includes a guide post (104) protruding up from the rear end, and the guide base (12) contains an elongated slot (122) defined in the rear end to receive the guide post (104). The guide base (12) includes a first retaining piece (126) formed on the rear end thereof, and a second retaining piece (124) formed on the other end, and the outer magazine (144) contains a first retaining slot (148) to receive the first retaining piece (126). The outer magazine (144) together with the inner magazine (142) contains a second retaining slot (146) to receive the second retaining piece (124). The guide base (12) includes an elastic strip (128) received in the first retaining slot (148) and abutting the first retaining piece (126) to press the staple magazine (14).

The stapler further comprises a guide rod (15) mounted in the staple magazine (14) and having one end secured to the first retaining piece (126) and the other end secured to the second retaining piece (124), and a biasing member (152) mounted on the guide rod (15) and having one end secured to the first retaining piece (126) and the other end secured to the slide base (17) to slide therewith.

Figure 4:
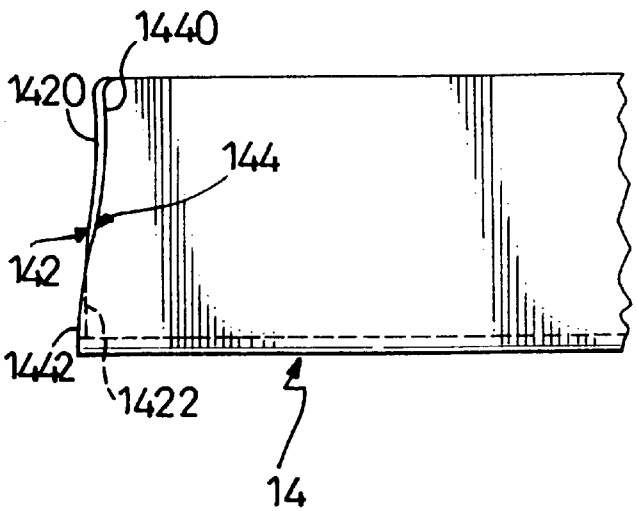
FIG. 4 is a partially cut away side plan view showing the outer magazine and the inner magazine of the stapler as shown in FIG. 1.

Referring to FIG. 4, the outer magazine (144) has an upper portion (1440) located inward of the upper portion (1420) of the inner magazine (142), and a lower portion (1442) located outward of the lower portion (1422) of the inner magazine (142).

Figure 5:
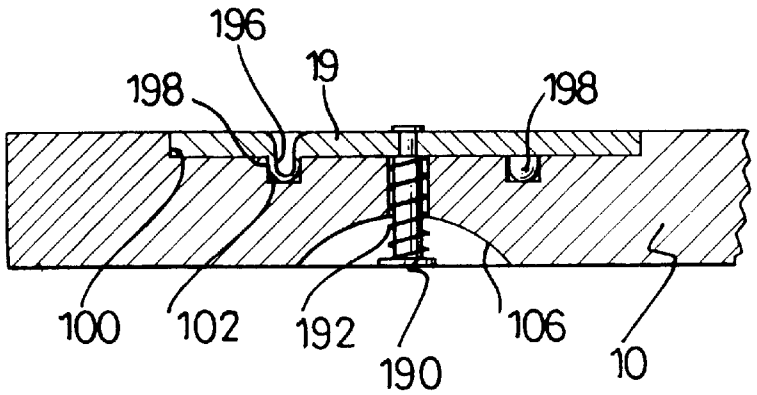
FIG. 5 is a partial side plan view in partial section of the stapler as shown in FIG. 1.

Referring to FIG. 5 with reference to FIG. 1, the front end of the support base (10) contains a recessed area (100) defined in the top thereof, and an arcuate recess (106) defined in the bottom thereof, and the stapler comprises a staple guide plate (19) detachably received in the recessed area (100), a drive post (190) extending through the support base (10) and having one end secured to the staple guide plate (19), and the other enlarged end received in the arcuate recess (106), and a biasing member (192) mounted around the drive post (190). The staple guide plate (19) contains two sets of arcuate indents (193, 196). Each set includes two pairs of indents on opposite sides of the staple guide plate (19). One set of indents includes adjacent arcuate indents, and the other set includes two separated arcuate indents. The recessed area (100) contains a plurality of retaining grooves (102), and the staple guide plate (19) includes a plurality of inserts (198) secured in the retaining grooves (102).

Figure 6:
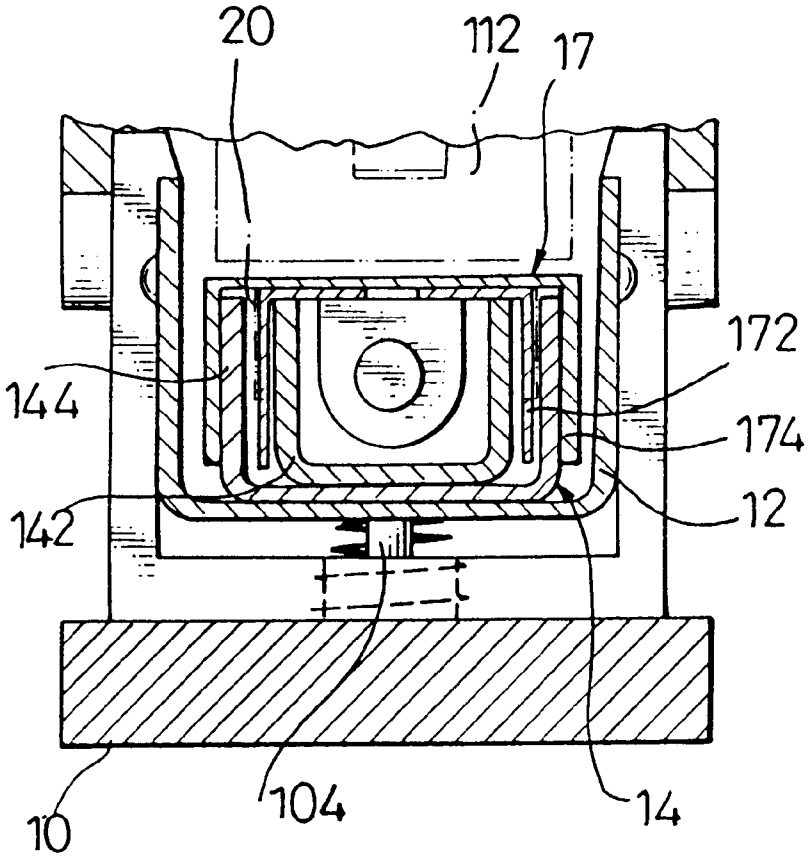
FIG. 6 is a rear plan view in partial section of the stapler as shown in FIG. 1.
Figure 7:
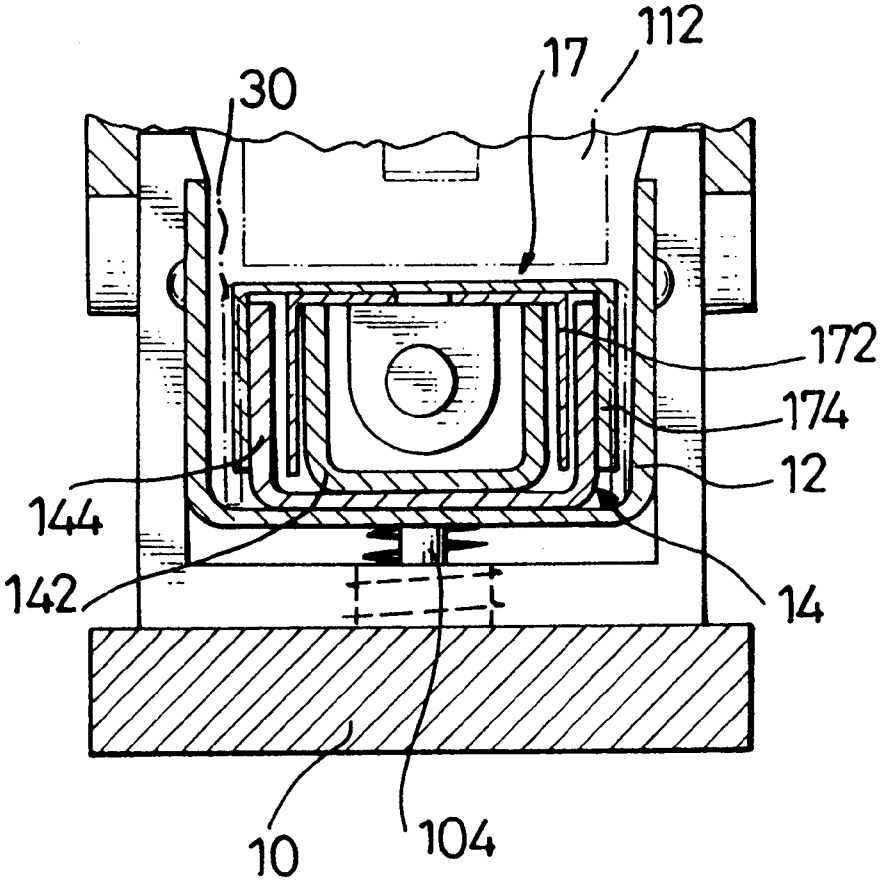
FIG. 7 is a rear plan view in partial section of the stapler as shown in FIG. 1.

In operation, referring to FIGS. 6 and 7 with reference to FIGS. 1–5, first staples (20) of a smaller size are mounted between the inner magazine (142) and the outer magazine (144) and are pressed by the inner pusher (172) as shown in FIG. 6, and second staples (30) of a larger size are mounted between the outer magazine (144) and the guide base (12), and are pressed by the outer pusher (174) as shown in FIG. 7. The two pairs of first indents (196) are used to bend the small staples (20), and the two pairs of second indents (193) are used to bend the large staples (20). The drive post (190) can be pushed upward to lift the staple guide plate (19) which can be pivoted relative to the support base (10) about the drive post (190), thereby changing the location of the first indents (196) and the second indents (193) and selecting which set of indents will be aligned below the staple ejector (112) such that the staple guide plate (19) can be used to bend the large staples (20) and the small staples (30), thereby increasing the versatility of the stapler.

The outer magazine (144) has two sidewalls. and the staple ejector (112) contains two guide slits (114) each aligning with one of the two sidewalls of the outer magazine (144) so as to facilitate a user ejecting the smaller first staples (20) by the staple ejector (112).

It should be clear to those skilled in the art that further embodiments may be made without departing from the scope of the present invention.

What is claimed is:

1. A stapler comprising:

a support base (10);

a guide base (12) with one end pivotally attached to the rear end of said support base (10);

a staple magazine (14) mounted in said guide base (12) and including an outer magazine (144) secured in said guide base (12) and an inner magazine (142) secured in said outer magazine (144);

a slide base (17) slidably mounted on said guide base (12) and including an outer pusher (174) slidably mounted between said guide base (12) and said outer magazine (144), and an inner pusher (172) secured in said outer pusher (174) and slidably mounted between said outer magazine (144) and said inner magazine (142); and a press cover (11) with one end pivotally attached to the rear end of said support base (10).

2. The stapler in accordance with claim 1, wherein said support base (10) includes a guide post (104) protruding up from the rear end, and said guide base (12) contains an elongated slot (122) defined in the rear end thereof to receive said guide post (104).

3. The stapler in accordance with claim 1, wherein said guide base (12) includes a first retaining piece (126) formed on the rear end thereof, and a second retaining piece (124) formed on the other end thereof, and said outer magazine (144) contains a first retaining slot (148) to receive said first retaining piece (126) therein, and a second retaining slot (146) to receive said second retaining piece (124) therein.

4. The stapler in accordance with claim 3, wherein said guide base (12) includes an elastic strip (128) received in said first retaining slot (148) and abutting said first retaining piece (126).

5. The stapler in accordance with claim 3, further comprising a guide rod (15) mounted in said staple magazine (14) and having one end secured to said first retaining piece (126) and the other end secured to said second retaining piece (124), and a biasing member (152) mounted on said guide rod (15) and having one end secured to said first retaining piece (126) and the other end secured to said slide base (17) to slide therewith.

6. The stapler in accordance with claim 1, further comprising an end cap (18) mounted in said press cover (11), and having one end pivotally attached to said rear end of said press cover (11), and other end secured to the other end of said press cover (11), and a press block (182) secured in the front end of said end cap (18).

7. The stapler in accordance with claim 6, further comprising a linking member (184) having a one end pivotally attached to said first end of said end cap (18) and the other end secured to said slide base (17).

8. The stapler in accordance with claim 1, wherein said outer magazine (144) has two sidewalls, said press cover (11) includes a staple ejector (112) protruding down from the front end thereof, and said staple ejector (112) contains two guide slits (114) aligning with one of said two corresponding sidewalls of said outer magazine (144).

9. The stapler in accordance with claim 1, wherein the front end of said support base (10) contains a recessed area (100) defined in the top thereof, and an arcuate recess (106) defined in the bottom thereof, and said stapler further comprises a staple guide plate (19) detachably received in said recessed area (100), a drive post (190) extending through said support base (10) and having one end secured to said staple guide plate (19), and the other end received in said arcuate recess (106), and a biasing member (192) mounted around said drive post (190).

10. The stapler in accordance with claim 9, wherein said recessed area (100) contains a plurality of retaining grooves (102), and said staple guide plate (19) includes a plurality of inserts (198) secured in said retaining grooves (102).

11. The stapler in accordance with claim 9, wherein said staple guide plate (19) contains two sets of arcuate indents (193, 196) each set includes two pairs of indents on opposite sides of the staple guide plate (19) with one set of indents (193) to accommodate small staples and the other set of indents (196) to accommodate large staples, and each set of indents includes a pair of adjacent arcuate indents and a pair of two separated arcuate indents.

* * * * *